United States Patent [19]

Engstrom et al.

[11] 4,196,257

[45] Apr. 1, 1980

[54] BI-ALKALI TELLURIDE PHOTOCATHODE

[75] Inventors: Ralph W. Engstrom; Arthur F. McDonie, both of Lancaster, Pa.

[73] Assignee: RCA Corporation, New York, N.Y.

[21] Appl. No.: 926,338

[22] Filed: Jul. 20, 1978

[51] Int. Cl.[2] ..... H01J 39/06; H01J 1/14

[52] U.S. Cl. ..... 428/457; 313/94; 313/373; 428/539; 428/913

[58] Field of Search ..... 428/539, 538, 913, 457; 427/76, 74, 75, 109, 166, 250, 295; 313/94, 373

[56] References Cited

U.S. PATENT DOCUMENTS

| | | | |
|---|---|---|---|
| 2,668,778 | 2/1954 | Taft | 313/373 X |
| 2,770,561 | 11/1956 | Sommer | 313/373 X |
| 2,868,736 | 1/1959 | Weinreich | 427/76 |
| 3,006,786 | 10/1961 | Sjoberg | 313/94 X |
| 3,020,432 | 2/1962 | Nicholson | 427/76 X |
| 3,434,876 | 3/1969 | Stoudenheimer | 313/373 X |
| 3,867,662 | 2/1975 | Endriz et al. | 313/94 |
| 3,902,924 | 9/1975 | Maciolek et al. | 427/76 X |
| 4,098,617 | 7/1978 | Lidorenko et al. | 427/74 |

*Primary Examiner*—Harold Ansher

*Attorney, Agent, or Firm*—Eugene M. Whitacre; Glenn H. Bruestle; Vincent J. Coughlin, Jr.

[57] ABSTRACT

A photocathode is formed by depositing a film of tellurium on a conductive base and then sensitizing the tellurium with at least two different alkali metals such as cesium and potassium or sodium and potassium. The photocathode has high sensitivity in the ultraviolet region and is substantially insensitive to solar radiation through the earth's atmosphere. Such a photocathode is useful in "solar-blind" detectors.

16 Claims, 2 Drawing Figures

BI-ALKALI TELLURIDE PHOTOCATHODE

BACKGROUND OF THE INVENTION

1. Field of the Invention

This invention relates to a photocathode suitable for use in a photomultiplier tube and more particularly to a photocathode having high sensitivity in the ultraviolet region and substantial insensitivity to solar radiation through the earth's atmosphere, and to methods of making such photocathodes.

2. Description of the Prior Art

It is well known that radiation of the sun through the earth's atmosphere has a wavelength greater than approximately 290 nanometers (nm), the so-called "solar edge". In certain ultraviolet detectors, it is desirable to obtain a maximum response at wavelengths shorter than 290 nm and a minimum response at wavelengths longer than 290 nm. Such a detector could operate in full daylight because of the almost total absorption of sunlight below 290 nm. This type of system is known as the "solar-blind" system because of its sensitivity in the ultraviolet region and insensitivity to solar radiation through the atmosphere.

Most of the known "solar-blind" detectors are photomultiplier tubes incorporating a cesium telluride ($Cs_2Te$) or a rubidium telluride ($Rb_2Te$) photocathode. These photocathodes have reasonably good response in the ultraviolet region but the longer wavelength response is greater than 290 nm. For operation as a "solar-blind" detector, a system utilizing these photocathodes requires complicated optical filtering to eliminate the sensitivity to wavelengths longer than 290 nm. A photocathode having a reduction or elimination of the out-of-band response is thus desirable to relieve the requirement of the solar-rejection filter and to thereby increase the system performance.

SUMMARY OF THE INVENTION

An electron emissive photocathode comprises a conductive base, a photoemissive surface including tellurium sensitized with at least two different alkali metals. Also provided is a method of making the electron emissive photocathode.

DETAILED DESCRIPTION OF THE PREFERRED EMBODIMENT

The formation of single alkali telluride in a stoichiometric compound for use as a photocathode has been known previously. U.S. Pat. No. 2,668,778 to Taft, issued Feb. 9, 1954 discloses a photoemitter formed of cesium telluride ($Cs_2Te$) or rubidium telluride ($Rb_2Te$). These photocathodes are highly sensitive in the ultraviolet region with substantially no sensitivity to visible light but which have a long wavelength cut-off greater than 300 nm.

Figure 1:
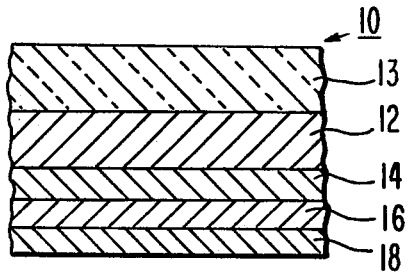
FIG. 1 is a cross-sectional elevation view of one embodiment of a bi-alkali telluride photocathode made according to the present method.

Referring to the drawing, there is shown in FIG. 1 a photocathode 10 made according to the present method. The photocathode 10 is formed to have a high sensitivity in the ultraviolet region while being substantially insensitive to solar radiation through the atmosphere. The photocathode is formed by depositing a transparent conductive base 12 onto a substrate 13, e.g., a glass end wall or faceplate of the envelope of a photomultiplier tube. The conductive base 12 is preferably formed of chromium or platinum. The base 12 of chromium or platinum is vapor deposited by known techniques, the thickness being monitored such that about 85–90% of the incident visible light is transmitted.

In a preferred method of preparing the photoemissive body of the photocathode 10, a film 14 of tellurium is first deposited onto the conductive base 12, for example, by evaporation. The thickness of the tellurium film 14 is monitored according to the transmitted light. A suitable thickness is such that the transmitted light is reduced by about 5%.

The tellurium film 14 is then sensitized by the deposition of a layer 16 of potassium while the film 14 is at a temperature of from 160°–190° C. This composite layer of tellurium and potassium is then sensitized by the deposition of a layer 18 of cesium while the tellurium-potassium layer is at a temperature of from 140°–170° C. Thus, the temperature for sensitizing the tellurium film 14 by cesium and potassium is in the range from 140°–190° C. Repetitive processing may be utilized to enhance the sensitivity of the photocathode. Thus, the sequence of operations may be: Te, K, Cs; Te, K, Cs; etc. Photoemission of the photocathode 10 during its formation may be monitored with a tungsten lamp for visible response and with a quartz mercury lamp for ultraviolet response. Processing may be terminated as the ultraviolet response is maximized and the visible response minimized.

In addition to the photocathode 10 as described, other alkali metals may be utilized to sensitize the tellurium film 14. For example, the tellurium film 14 may be sensitized with sodium at a temperature of from 190°–220° C. This composite layer of tellurium and sodium may then be sensitized with potassium at a temperature of from 160°–190° C. Thus, the temperature of sensitizing a telluride film 14 with sodium and potassium is in the range of from 160°–220° C. Of the two bi-alkali photocathodes 10 suggested, the Na—K—Te type has been found to provide the shorter wavelength response.

In each of the above-described methods of forming a photocathode 10, it is belived that the compounds formed are stoichiometric or nearly so. Thus, approximate formulas for the two described photocathodes 10 may be generally written as $K_xCs_{2-x}Te$ and $Na_xK_{2-x}Te$, respectively, wherein $0 < x < 2$.

It has also been found that the order in which the tellurium and the two different alkali metals are deposited is not limited to the order as set forth above. For example, in the case of K—Cs—Te, one of the alkali metals may be deposited prior to the deposition of the tellurium and the order of the alkali metals may also be interchanged.

Figure 2:
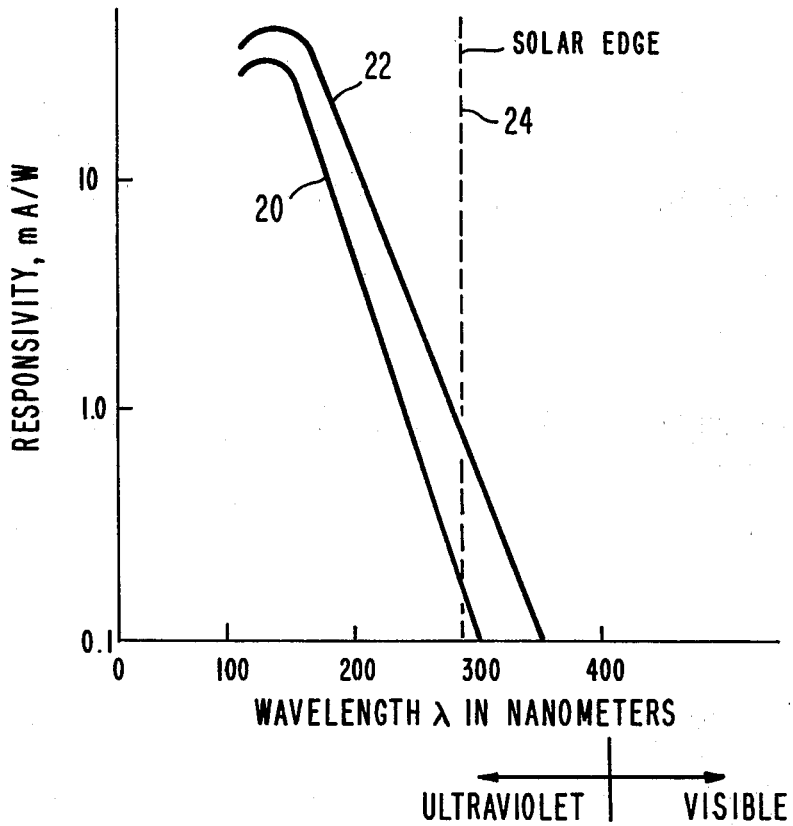
FIG. 2 is a graph comparing the spectral response of the photocathode of FIG. 1 with the spectral response of a photocathode made by previous methods.

Photocathodes made in the manner hereindescribed have been measured and show a high sensitivity to radiation in the ultraviolet region and substantial insensitivity to solar radiation. FIG. 2 is a graph showing the spectral response of photocathodes made by the present methods, indicated by curve 20, while curve 22 represents a photocathode, such as $Cs_2Te$ made by prior art techniques. The ordinate of the graph is milliamperes per watt (mA/W) and the abscissa is wavelength (λ), measured in nanometers. It will be seen that the response of the photocathode made by present methods has a substantially lower response to solar radiation at the "solar edge", represented by the dashed line 24 at 290 nm. The lower spectral response of the present photocathode will advantageously permit an optical filter of a less complicated nature than standard filters used in "solar-blind" systems.

It has been determined that the sensitizing of tellurium with at least two different alkali metals has the effect of reducing the out-of-band response and lowering the dark current. Such properties are desirable in detection systems.

What is claimed is:

1. In an electron emissive photocathode of the type having sensitivity to light in the ultra violet region and substantial insensitivity to light in the spectral region above 400 nanometers, said photocathode including a conductive base and a photoemissive surface on said base, the improvement wherein said photoemissive surface comprises tellurium and at least two different alkali metals.

2. A photocathode according to claim 1, wherein said alkali metals are selected from the group consisting of cesium, potassium and sodium that are reacted with said tellurium to form a photoemissive surface having negligible sensitivity to solar radiation through the atmosphere.

3. A photocathode according to claim 2, wherein said alkali metals are cesium and potassium.

4. A photocathode according to claim 3, wherein said tellurium, cesium and potassium are in substantially stoichiometric proportions according to the formula $K_x Cs_{2-x} Te$, wherein $0<x<2$.

5. A photocathode according to claim 2, wherein said alkali metals are sodium and potassium.

6. A photocathode according to claim 5, wherein said tellurium, sodium and potassium are in substantially stoichiometric proportions according to the formula $Na_x K_{2-x} Te$, wherein $0<x<2$.

7. A method of making an electron emissive photocathode comprising the steps of depositing successively onto a conductive base tellurium and at least two different alkali metals that react with said tellurium to form a photoemissive surface having sensitivity to light in the ultra violet region and substantial insensitivity to light in the spectral region above 400 namometers.

8. A method according to claim 7, wherein said alkali metals are selected from the group consisting of cesium, potassium and sodium to form a photoemissive surface having negligible sensitivity to solar radiation through the atmosphere.

9. A method according to claim 8, wherein said alkali metals are cesium and potassium.

10. A method according to claim 9, wherein said cesium and potassium deposition is effected at a temperature range from about 140° C. to about 190° C.

11. A method according to claim 9 wherein said cesium and potassium are reacted stoichiometrically with said tellurium according to the formula $K_x Cs_{2-x} Te$, wherein $0<x<2$.

12. A method according to claim 8, wherein said alkali metals are sodium and potassium.

13. A method according to claim 12, wherein said sodium and potassium deposition is effected at a temperature range from about 160° C. to about 220° C.

14. A method according to claim 12, wherein said sodium and potassium are reacted stoichiometrically with said tellurium according to the formula $Na_xK_{2-x}Te$, wherein $0<x<2$.

15. A photocathode according to claim 7, wherein said tellurium is first deposited onto said base followed by successive depositions of said different alkali metals.

16. A photocathode according to claim 7, wherein one of said alkali metals is first deposited onto said base.

* * * * *